US009021614B2

(12) United States Patent
Tepper et al.

(10) Patent No.: US 9,021,614 B2
(45) Date of Patent: May 5, 2015

(54) LEG PROTECTOR FOR SPORTS ACTIVITIES

(75) Inventors: John C. Tepper, Carrollton, TX (US); Amy B. Weiner, San Diego, CA (US); Gary Bledsoe, Grand Prairie, TX (US); Lawrence J. Lemak, Birmingham, AL (US); Kelly J. Nolan, Roanoke, TX (US); Michael A. Lorenz, Jr., Gahanna, OH (US); Chad M. Leeder, Orrville, OH (US); Craig A. Brewer, Dallas, TX (US)

(73) Assignee: Medical Techology, Inc., Grand Prairie, TX (US)

( * ) Notice: Subject to any disclaimer, the term of this patent is extended or adjusted under 35 U.S.C. 154(b) by 306 days.

(21) Appl. No.: 13/399,776

(22) Filed: Feb. 17, 2012

(65) Prior Publication Data

US 2012/0233736 A1 Sep. 20, 2012

Related U.S. Application Data

(60) Provisional application No. 61/444,473, filed on Feb. 18, 2011.

(51) Int. Cl.

| | |
|---|---|
| ***A41D 13/06*** | (2006.01) |
| ***A41D 13/015*** | (2006.01) |
| ***A63B 71/12*** | (2006.01) |

(52) U.S. Cl.

CPC ..... *A41D 13/065* (2013.01); *A41D 13/0153* (2013.01); *A63B 71/1225* (2013.01); *A63B 2071/1241* (2013.01); *A63B 2071/125* (2013.01)

(58) Field of Classification Search

CPC ..... A41D 13/0543; A41D 13/065; A41D 13/0015; A41D 13/0153; A41D 13/0568; A41D 13/06; A61F 5/0123; A61F 5/01; A61F 5/0125; A61F 5/0106; A61F 2005/0165; A61F 2005/0172; A61F 2005/0176; A61F 2005/0137; A61F 13/061; A61H 3/00; A61H 1/024; A63B 71/1225; A63B 71/12; A63B 207/125

USPC ..... 2/24, 22, 267; 602/16, 26

See application file for complete search history.

(56) References Cited

U.S. PATENT DOCUMENTS

| | | | |
|---|---|---|---|
| 21,872 | A | 10/1858 | Bunce |
| 552,143 | A | 12/1895 | Rankin |

(Continued)

FOREIGN PATENT DOCUMENTS

| | | |
|---|---|---|
| DE | 170739 | 5/1906 |
| DE | 357243 | 8/1922 |

(Continued)

OTHER PUBLICATIONS

Komistek, Richard D. et al., "An In Vitro Analysis of the Effectiveness of the Osteoarthritic Knee Brace During Heel Strike of Gait," 1999, 12 pages, vol. 14, No. 6, Journal of Arthroplasty (printed from Bledsoe Brace Systems website: http://bledsoebrace.com/studies/rose.htm).

(Continued)

*Primary Examiner* — Andrew W Collins

(74) *Attorney, Agent, or Firm* — K&L Gates LLP

(57) ABSTRACT

An embodiment of a leg protector of the present disclosure includes an upper thigh pad that is structurally attached to an upper bracing shell including lateral and medial uprights. The upper shell and thigh pad can be held to the player via a strap and/or garment. The uprights extend to uni- or polycentric hinges arranged on, and in one embodiment biased against, either side of the player's knee. A connecting member extends in a frontward direction from each hinge and attaches to a patella pad held in place over the player's knee. The patella pad may additionally be connected to the thigh pad via one or more connecting strip. Each hinge is also connected to a lower bracing shell, which includes lateral and medial uprights that extend down and around the player's lower leg, anteriorly or posteriorly. The lower shell can also be fitted via a strap or garment.

33 Claims, 12 Drawing Sheets

(56) References Cited

U.S. PATENT DOCUMENTS

| | | | | |
|---|---|---|---|---|
| 1,381,290 | A | | 6/1921 | Diadul |
| 2,250,493 | A | | 7/1941 | Milne |
| 2,558,986 | A | | 7/1951 | Seelert |
| 3,046,981 | A | | 7/1962 | Biggs et al. |
| 3,785,371 | A | | 1/1974 | Lewis |
| 3,805,773 | A | | 4/1974 | Sichau |
| 3,817,244 | A | | 6/1974 | Taylor |
| 3,902,482 | A | | 9/1975 | Taylor |
| 4,057,056 | A | | 11/1977 | Payton |
| 4,057,853 | A | | 11/1977 | McLane |
| 4,090,508 | A | | 5/1978 | Gaylord, Jr. |
| 4,115,902 | A | | 9/1978 | Taylor |
| 4,220,148 | A | | 9/1980 | Lehneis |
| 4,240,414 | A | | 12/1980 | Theisler |
| 4,256,097 | A | | 3/1981 | Willis |
| 4,271,831 | A | | 6/1981 | Deibert |
| 4,337,764 | A | | 7/1982 | Lerman |
| 4,340,041 | A | | 7/1982 | Frank |
| 4,361,142 | A | | 11/1982 | Lewis et al. |
| 4,370,977 | A | | 2/1983 | Mauldin et al. |
| 4,379,463 | A | | 4/1983 | Meier et al. |
| 4,381,768 | A | | 5/1983 | Erichsen et al. |
| D269,379 | S | | 6/1983 | Bledsoe |
| 4,463,751 | A | | 8/1984 | Bledsoe |
| 4,487,200 | A | | 12/1984 | Feanny et al. |
| 4,506,661 | A | | 3/1985 | Foster |
| 4,531,731 | A | | 7/1985 | Law |
| 4,554,913 | A | | 11/1985 | Womack et al. |
| 4,556,053 | A | | 12/1985 | Irons |
| 4,565,190 | A | | 1/1986 | Pirmantgen et al. |
| 4,572,170 | A | | 2/1986 | Cronk et al. |
| 4,573,455 | A | | 3/1986 | Hoy |
| 4,599,998 | A | | 7/1986 | Castillo |
| 4,614,181 | A | | 9/1986 | Karlsson |
| 4,620,532 | A | | 11/1986 | Houswerth |
| 4,624,247 | A | | 11/1986 | Ford |
| 4,632,097 | A | | 12/1986 | Brooks |
| 4,632,098 | A | | 12/1986 | Grundei et al. |
| 4,633,867 | A | | 1/1987 | Kausek et al. |
| 4,635,623 | A | | 1/1987 | Charuest et al. |
| 4,649,906 | A | | 3/1987 | Spademan |
| 4,697,583 | A | | 10/1987 | Mason et al. |
| 4,699,129 | A | | 10/1987 | Aaserude et al. |
| 4,723,539 | A | | 2/1988 | Townsend |
| 4,765,318 | A | | 8/1988 | Tranberg et al. |
| 4,781,180 | A | | 11/1988 | Solomonow |
| 4,791,916 | A | | 12/1988 | Paez |
| 4,793,333 | A | | 12/1988 | Marquette |
| 4,796,610 | A | | 1/1989 | Cromartie |
| 4,803,975 | A | | 2/1989 | Meyers |
| 4,805,606 | A | | 2/1989 | McDavid, III |
| 4,817,588 | A | | 4/1989 | Bledsoe |
| 4,846,842 | A | | 7/1989 | Connolly et al. |
| 4,856,501 | A | | 8/1989 | Castillo et al. |
| 4,881,532 | A | | 11/1989 | Borig et al. |
| 4,940,045 | A | | 7/1990 | Cromartie |
| 4,955,369 | A | | 9/1990 | Bledsoe et al. |
| 5,056,509 | A | | 10/1991 | Swearington |
| 5,078,127 | A | * | 1/1992 | Daneman et al. ..... 602/16 |
| 5,107,824 | A | | 4/1992 | Rogers et al. |
| 5,131,385 | A | | 7/1992 | Kuehnegger et al. |
| 5,259,832 | A | | 11/1993 | Townsend et al. |
| 5,277,698 | A | | 1/1994 | Taylor |
| 5,295,303 | A | | 3/1994 | Ogawa et al. |
| 5,302,169 | A | | 4/1994 | Taylor |
| 5,316,547 | A | | 5/1994 | Gildersleeve |
| 5,383,845 | A | | 1/1995 | Nebolon |
| 5,400,806 | A | | 3/1995 | Taylor |
| 5,409,449 | A | | 4/1995 | Nebolon |
| 5,415,625 | A | | 5/1995 | Cassford et al. |
| 5,454,383 | A | | 10/1995 | Nebolon |
| 5,456,659 | A | | 10/1995 | Gildersleeve et al. |
| 5,458,565 | A | | 10/1995 | Tillinghast, III et al. |
| 5,520,622 | A | | 5/1996 | Bastyr et al. |
| 5,527,268 | A | | 6/1996 | Gildersleeve et al. |
| D372,983 | S | | 8/1996 | Nebolon |
| 5,542,911 | A | | 8/1996 | Cassford et al. |
| 5,544,663 | A | * | 8/1996 | Duback ..... 128/846 |
| 5,586,970 | A | | 12/1996 | Morris et al. |
| 5,611,774 | A | | 3/1997 | Postelmans |
| 5,662,596 | A | | 9/1997 | Young |
| 5,672,152 | A | | 9/1997 | Mason et al. |
| 5,743,865 | A | | 4/1998 | Townsend |
| 5,766,140 | A | | 6/1998 | Tillinghast, III et al. |
| 5,772,618 | A | | 6/1998 | Mason et al. |
| 5,782,780 | A | | 7/1998 | Mason et al. |
| 5,807,294 | A | | 9/1998 | Cawley et al. |
| 5,827,208 | A | | 10/1998 | Mason et al. |
| 5,954,621 | A | | 9/1999 | Joutras et al. |
| 5,976,063 | A | | 11/1999 | Joutras et al. |
| 6,413,232 | B1 | | 7/2002 | Townsend et al. |
| 6,527,733 | B1 | | 3/2003 | Ceriani et al. |
| 6,752,775 | B2 | | 6/2004 | Seligman et al. |
| 6,936,019 | B2 | | 8/2005 | Mason |
| 6,960,177 | B2 | | 11/2005 | Turrini et al. |
| 6,969,364 | B2 | | 11/2005 | Sterling |
| 7,059,329 | B2 | | 6/2006 | Mason et al. |
| 7,060,045 | B2 | | 6/2006 | Mason et al. |
| 7,201,728 | B2 | | 4/2007 | Sterling |
| 7,235,059 | B2 | | 6/2007 | Mason et al. |
| 7,306,572 | B2 | | 12/2007 | Ceriani et al. |
| 7,311,687 | B2 | | 12/2007 | Hoffmeier et al. |
| 7,479,122 | B2 | | 1/2009 | Ceriani et al. |
| 7,485,103 | B2 | | 2/2009 | Mason et al. |
| 7,500,957 | B2 | | 3/2009 | Bledsoe |
| 7,749,183 | B2 | * | 7/2010 | Ingimundarson et al. ..... 602/26 |
| 8,048,013 | B2 | * | 11/2011 | Ingimundarson et al. ..... 602/26 |
| 8,141,169 | B2 | * | 3/2012 | Saranga ..... 2/22 |
| 8,348,876 | B2 | * | 1/2013 | Ingimundarson et al. ..... 602/26 |
| 2003/0153856 | A1 | | 8/2003 | Seligman et al. |
| 2004/0002674 | A1 | | 1/2004 | Sterling |
| 2004/0054311 | A1 | * | 3/2004 | Sterling ..... 602/26 |
| 2005/0277859 | A1 | * | 12/2005 | Carlsmith ..... 602/20 |
| 2006/0206045 | A1 | | 9/2006 | Townsend et al. |
| 2008/0195014 | A1 | * | 8/2008 | Ingimundarson et al. ..... 602/26 |
| 2008/0208095 | A1 | | 8/2008 | Kazmierczak et al. |
| 2010/0010409 | A1 | | 1/2010 | Bejarano |
| 2010/0121242 | A1 | * | 5/2010 | Chiang ..... 602/26 |
| 2012/0143111 | A1 | | 6/2012 | Bledsoe et al. |
| 2012/0271211 | A1 | | 10/2012 | Bledsoe |
| 2013/0116610 | A1 | * | 5/2013 | Ingimundarson et al. ..... 602/26 |

FOREIGN PATENT DOCUMENTS

| | | |
|---|---|---|
| DE | 846895 | 8/1952 |
| DE | 1024204 | 2/1958 |
| DE | 2239382 | 2/1974 |
| DE | 19945829 | 4/2001 |
| GB | 110209 | 10/1917 |
| GB | 1449554 | 9/1976 |
| GB | 2136294 | 9/1984 |
| GB | 2163352 | 2/1986 |
| WO | 8502536 | 6/1985 |
| WO | 97/29717 | 8/1997 |
| WO | 2012/075148 | 6/2012 |

OTHER PUBLICATIONS

Hewitt, Timothy E. et al., "Decrease in Knee Joint Pain and Increase in Function in Patients with Medical Compartment Arthroris: A Perspective Analysis of Valgus Bracing," 1998, 16 pages, vol. 21, No. 2, Orthopedics (printed from Bledsoe Brace Systems website: http://bledsoebrace.com/studies/cinci.htm).

International Preliminary Report on Patentability for International Patent Application No. PCT/US2011/062658 mailed Mar. 11, 2013.

International Preliminary Report on Patentability for International Patent Application No. PCT/US2011/0335338 mailed Aug. 13, 2013.

International Search Report PCT/US2011/062658 mailing date Jun. 29, 2012.

International Search Report PCT/US2011/033538 mailing date Jul. 4, 2012.

* cited by examiner

LEG PROTECTOR FOR SPORTS ACTIVITIES

PRIORITY CLAIM

This application claims priority to and the benefit of U.S. Provisional Patent Application Ser. No. 61/444,473, entitled, "Knee Protector For Sports Activities", filed Feb. 18, 2011, the entire contents of which is incorporated herein by reference and relied upon.

BACKGROUND

Sports related injuries and the effects of contact sports on young athletes have gained heightened awareness. In particular, there is increased awareness and concern related to concussions and knee injuries caused during contact sports, especially American football. The concern is prevalent from the professional level down to high school football, and even to younger leagues. While head injuries have taken one center stage, there can be little dispute that the week link in a player's body is the player's knee. Knee injuries occur at all levels of sports, as do head injuries. Further, while the football helmet, for example, has undergone significant development to combat head injury, little has been done regarding padding for other sensitive areas of the player's body, such as the player's knees. Applicants believe that significant strides can be made in the area of preventing knee related injuries in all levels of sports, and in particular in contact sports, such as American football.

Traditional football knee and thigh pads protect the player only from direct contact, and provide little or no side contact or twisting protection. Functional sports braces are available, but are worn typically only after injury and do not include padding. Football players can wear a metallic functional brace along with traditional knee and thigh pads. However, this combination can be cumbersome, heavy and expensive.

SUMMARY

The present disclosure relates to preventative orthopedics, and in particular, to a device intended to protect a player's knee and surrounding leg area.

The present disclosure sets forth a sports leg protector. It is contemplated to use the device in American football as one primary application, however, it is also contemplated to use the device with other sports, such as hockey, baseball, basketball, soccer (European football), lacrosse, rugby, cricket, skiing, and riding/racing, such as any type of manual powered (e.g., bicycle), animal powered (e.g., horse) or vehicular (e.g., car or motorcycle) riding or racing. The leg protector is worn around the player's knee. In one embodiment, the device incorporates the patella or knee protection provided to the player by a traditional knee pad (e.g., for American football), with thigh protection provided to the player by a traditional thigh pad (e.g., for American football), and with the prophylactic bracing of the knee joint to prevent typical sports knee injuries, for example to the player's anterior cruciate ligament ("ACL"), posterior cruciate ligament ("PCL"), and medial collateral ligament ("MCL").

The leg protector in an embodiment provides upper and lower brace shells, the upper shell including a strap that the player tightens around their thigh, the lower shell including a strap that the player tightens around their leg. The shells can be made of a strong, lightweight material, such as aluminum, magnesium, alloys thereof, plastic, and/or composite material. The top of the shell connects to or supports a thigh pad. The thigh pad can be a hard plastic pad having a soft cover. Or alternatively, the thigh pad can include a soft pad in combination with an underlying hard structure of the upper brace shell.

The bottom of the upper shell includes two uprights (medial and lateral), which each extend downwardly (when the leg protector is worn) to connect to a hinge (medial and lateral), e.g., at the top of the hinge. The top of the lower shell also includes two uprights (medial and lateral) that each connect to one of the two hinges, e.g., at the bottom of each hinge. The hinges can be uni- or polycentric, that is, pivot at a single or at multiple points. The medial and lateral uprights of each of the upper and lower shells support the strapping for attachment of the leg protector to the player. The hinges each include inner padding that in combination with the upper and lower uprights (which can be secured by straps above and below the knee joint) support and stabilize the knee joint during football or other sports play to help prevent knee injury.

The hinges also support a knee or patella pad, which can be a softer foam pad. The patella pad can connect to the hinges each via an elastic, fabric, plastic and/or metal connecting strip. A similar one or more strip connects the top of the patella pad to the bottom of the thigh pad in one embodiment, stabilizing both pads, while allowing the patella pad to float somewhat between the thigh pad and the bracing uprights. In an alternative embodiment, the patella or knee pad and the thigh pad are not physically linked together and are instead attached separately to the leg protector. The patella pad, thigh pad and connecting strips in either case are sized and spaced apart so as to fit onto the thigh and knee of the player. The connecting strips can be adjustable to allow the patella or knee pad to sit lower or ride higher relative to the thigh pad. It is contemplated to provide differently sized leg protectors for differently sized players and to provide left and right protectors, if needed, to allow the pads to be better contoured to the player's thigh and knee.

It is also contemplated to provide the leg protectors with one or more stretchable sleeve or undergarment that can be made of spandex, elastane material, or other type of stretchable fabric suitable for sports play. The sleeve(s) can be attached to the leg protector or be worn as a separate garment underneath the protector. The separate garment can have its own padding or additional layering at desired areas to provide supplemental impact protection. The separate garment can also support one or both of the primary thigh and/or knee or patella pads.

The present disclosure sets forth a number of ways that a pad, such as a knee or thigh pad, can be attached to a frame of the leg protector. In one embodiment, the pads are molded over the frame. Alternatively, the pads are halved, and fastened (permanently or removable) and/or adhered together about (and/or to) struts or members of the frame.

The frame can have apertures to remove weight and cost and to allow the protector to breathe. The frame can be bent or contoured to place a pad in a desired location. For example, the frame can offset the location of the thigh pad, such that the pad is moved to cover more of the outside of the player's thigh as well or the front of the thigh.

It is accordingly an advantage of the present disclosure to provide a sports leg protector that integrates multiple protective functions provided by traditional padding and post-injury bracing.

It is another advantage of the present disclosure to provide a sports leg protector that provides both knee and thigh protection from head-on or frontal impact.

It is a further advantage of the present disclosure to provide a sports leg protector that provides side impact and twisting protection for the player's knee.

It is yet another advantage of the present disclosure to provide an integrated sports leg protector that is lightweight.

It is yet a further advantage of the present disclosure to provide an integrated sports leg protector that is cost effective.

It is still another advantage of the present disclosure to provide an integrated sports leg protector that is easy to put on and remove.

It is still a further advantage of the present disclosure to provide an integrated sports leg protector that can be used in many sports, such as football, hockey, baseball, basketball, soccer, lacrosse, rugby, cricket, skiing, and riding/racing, such as any type of manual powered (e.g., bicycle), animal powered (e.g., horse) or vehicular (e.g., car or motorcycle) riding or racing.

Additional features and advantages are described herein, and will be apparent from the following Detailed Description and the figures.

DETAILED DESCRIPTION

Figure 1:
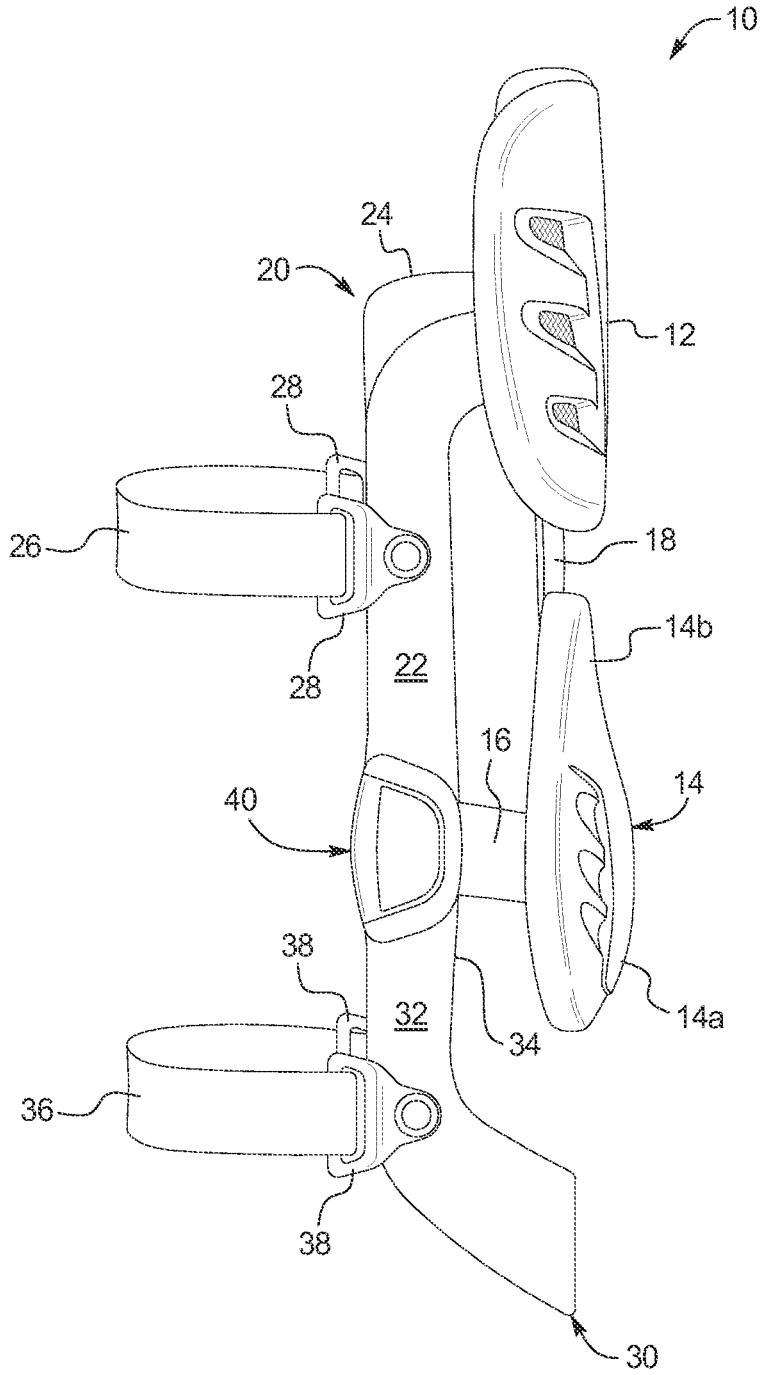
FIG. 1 is a perspective view of one embodiment of an integrated sports leg protector of the present disclosure.

Referring now to the drawings and in particular to FIG. 1, one embodiment of an integrated sports leg protector is illustrated by protector 10. Protector 10 includes a bracing component having an upper shell 20 and a lower shell 30. Upper and lower shells 20 and 30 can be made of rigid plastic, a composite material, metal and/or any combination thereof Aluminum, magnesium and alloys thereof may be used for example. Upper shell 20 includes a lateral upright 22 and a medial upright 24. Uprights 22 and 24 may extend into each other forming a continuous shell or terminate at separate ends.

A strap 26 extends from lateral upright 22 to medial upright 24 for securing upper shell 20 to the user's thigh. Strap 26 can be elastic and/or have an adjustment mechanism for tightening or loosening the strap, so that the player can readily secure shell 20 to the user's thigh. Strap 26 can be made of a nylon webbing for example. One or both sides of strap 26 can be secured to lateral upright 22 and/or medial upright 24 via a hinge mechanism 28 to provide additional flexibility in attaching and removing sports leg protector 10. One or both ends of strap 26 can be releasably secured to a respective one of the hinges 28, or to lateral or medial uprights 22 and 24 via a respective one of the hinges 28, for donning and removal of protector 10.

The lower ends of lateral upright 22 and medial upright 24 each attach to a respective lateral and medial hinge 40 (only lateral hinge seen in FIG. 1). Hinge 40 can be uni- or polycentric, that is, pivot about a single axis or about multiple axes, respectively. One suitable hinge for both lateral and medial hinges 40 is the hinge provided with a Z-13™ Knee Brace supplied by the assignee of the present disclosure. Hinge 40 can allow for an unlimited range of motion or be provided with one or more outward leg flex or inward leg curl motion stop to prevent an unnatural and potentially dangerous leg movement. Hinges 40 can have padding, e.g., foam padding, on their inside surfaces to provide cushioned interfaces with each side of the player's knee.

It is contemplated that hinges 40 for any of protectors 10, 110, 210, 310, 410, 510, 610 or 710 and associated alternatives discussed herein be eared hinges, such as, geared polycentric hinges, which dissipate direct forces for lateral knee protection. Hinges 40 can also be reinforced with spring steel to help absorb lateral loads and prevent or minimize medial collateral ligament ("MCL") and anterior collateral ligament ("ACL") injuries.

As illustrated, the bottoms of lateral upright 22 and medial upright 24 attach to a top of hinge 40. The bottom of each hinge 40 in turn attaches to a respective lateral upright 32 and medial upright 34 (not seen in FIG. 1) of lower shell 30. Uprights 32 and 34 extend into each other forming a continuous shell that extends around the anterior or front side of the patient's knee in the illustrated embodiment. A strap 36 extends from lateral upright 32 to medial upright 34 for securing lower shell 20 to the user's calf. Strap 36 can likewise be elastic and/or have an adjustment mechanism for tightening or loosening the strap, so that the player can readily secure shell 30 to the user's calf. Strap 36 can also be made of a nylon webbing for example. One or both sides of strap 36 can be secured to lateral upright 32 and/or medial upright 34 via a hinge mechanism 38 to provide additional flexibility in attaching and removing sports leg protector 10. Likewise, one or both ends of strap 36 can be releasably secured to a respective one of the hinges 38, or to lateral or medial uprights 32 and 34 via a respective one of the hinges 38, for donning and removal of protector 10.

As described above, leg protector 10 provides a prophylactic bracing mechanism that stabilizes the player's knee, protecting the knee from side impact forces and stabilizing the knee during contact and injurious twisting during play, such as during the play of American football. Additionally, the prophylactic bracing mechanism supports anterior or front impact pads similar to those associated for example with American football. In particular, the prophylactic bracing mechanism supports a thigh pad 12 and a knee pad 14.

Thigh pad 12 can have a hard plastic interior covered by a soft, thin foam, cover. Thigh pad 12 is secured to upper shell 20. It is contemplated to secure thigh pad 12 to upper shell 20 in a number of ways. For example, upper shell 20 can be a continuous shell with lateral upright 22 and medial upright 24 connected together, for which it is contemplated to extend the connected area of lateral upright 22 and medial upright 24 through thigh pad 12, so that the padding of thigh pad 12 is allowed to prominently contact the player's thigh. Alternatively, the continuous, connected area of lateral upright 22 and medial upright 24 can extend behind and connect to the inner surface of thigh pad 12, for example, if shell 20 is made sufficiently thin so as not to be felt or felt significantly by the player. Still further alternatively, if lateral upright 22 and medial upright 24 each terminate at an end (shell 20 not continuous), it is contemplated that the ends pierce or dig into the sides of thigh pad 12 to secure the pad. Here too, the separated ends of lateral upright 22 and medial upright 24 can alternatively be secured to an inner surface of thigh pad 12 if desired.

As illustrated in FIG. 1, knee pad 14 is secured flexibly within leg protector 10 so as to somewhat float relative to the system. Knee pad 14 in one embodiment is a soft or foam knee or patella pad having a rounded or cupped section 14*a* for covering the player's knee cap and a section 14*b* extending from cupped section 14*a* for providing upper knee protection and for transitioning towards thigh pad 12. Pads 12 and 14 may be made of vinyl nitride for example. Cupped section 14*a* is secured to lateral and medial hinges 40 via connecting straps 16 in the illustrated embodiment, which can be made of any of the flexible and/or elastic materials discussed above for straps 26 and 36. In the illustrated embodiment, extension section 14*b* is secured via one or more connecting strap 18 to the bottom of thigh pad 12. Connecting strap 18 can likewise be made of any of the flexible and/or elastic materials discussed above for straps 26 and 36.

Extension section 14*b* and connecting strap 18 are sized to space cupped section 14*a* and thigh pad 12 apart enough to cover the player's knee cap and thigh, respectively. It is also contemplated to allow connecting strap 18 to be adjusted shorter, or longer, enabling patella or knee pad 14 to be extended away from or pulled towards thigh pad 12. Different sizes of leg protector 10 are provided to fit differently sized players. Left and right versions of leg protector 10 can be provided if found beneficial. In particular, any one or more of shells 20 and 30 and pads 12 and 14 may be optimally configured in left and right versions. Also, it may be desirable to locate lateral hinge 40 operationally above or below medial hinge 40 when worn by the player, resulting in left and right versions of protector 10.

Figure 2:
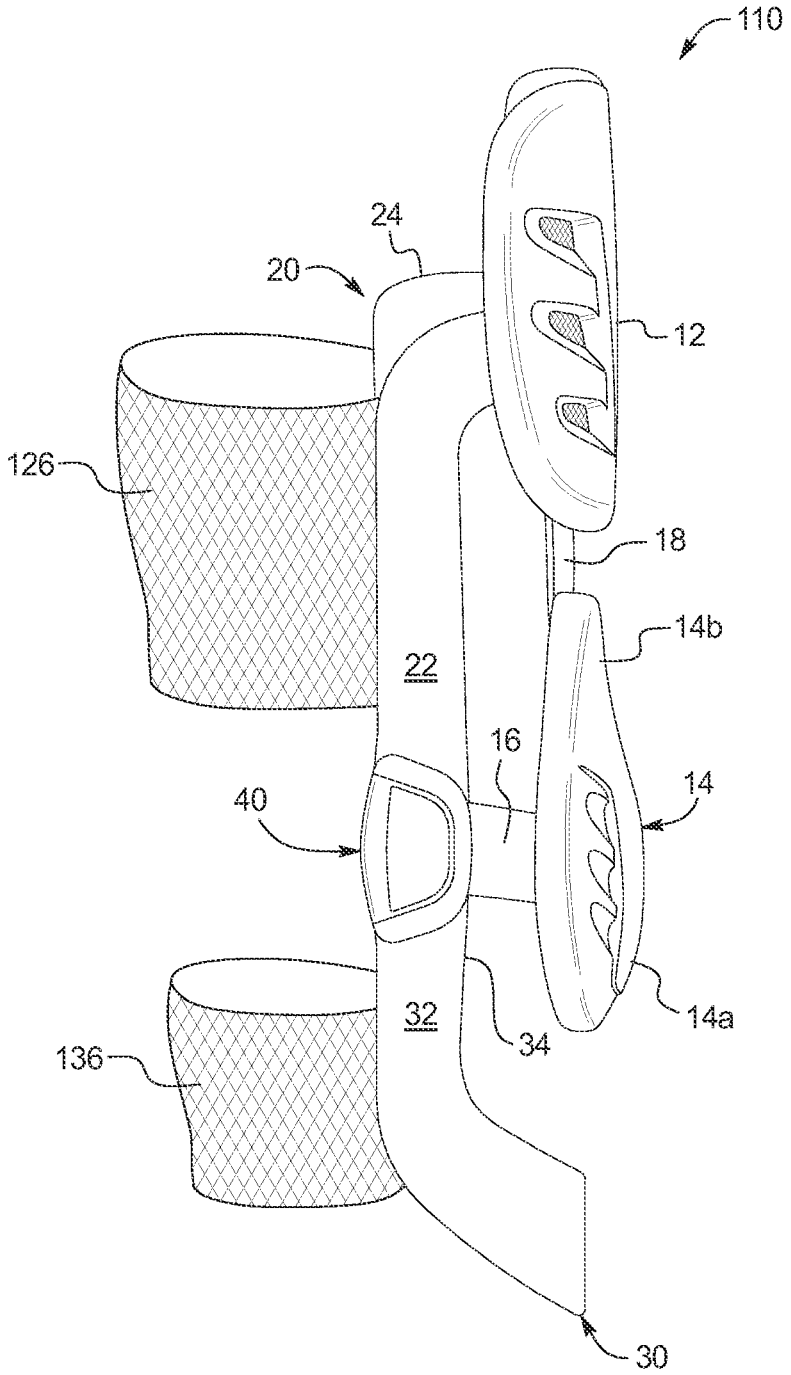
FIG. 2 is a perspective view of a second embodiment of an integrated sports leg protector of the present disclosure.

Referring now to FIG. 2, an alternative leg protector 110 is illustrated, in which all like features are numbered the same as in system 10 of FIG. 1. Leg protector 110 accordingly includes all of the relevant disclosure and alternatives discussed above for leg protector 10. The primary difference between protectors 10 and 110 is that straps 26 and 36 (and associated hinging) have been replaced by garment sleeves 126 and 136, respectively (although only one of straps 26 and 36 could be switched out if desired). Garment sleeves 126 and 136 can be made of a spandex or elastane material or of another synthetic fiber material having good elasticity. Garment sleeves 126 and 136 can be generally continuous as illustrated so that players insert their legs through the sleeves to don protector 110. Alternatively, one or both of garment sleeves 126 and 136 is slit and provided with attachable edges, via hook and pile attachment, so that protector 110 can alternately be translated onto (before attaching hook and pile edges at a desired tightness) and off of (after separating hook and pile edges) the player. Still further alternatively, one or both edges of either one or both of garment sleeves 126 and 136 can be removably attached, e.g., via hook and pile attachment, to the appropriate upright 22, 24, 32 and/or 34, so that protector 110 can alternately be translated onto (before attaching hook and pile at a desired tightness) and off of (after separating hook and pile) the player.

Figure 3:
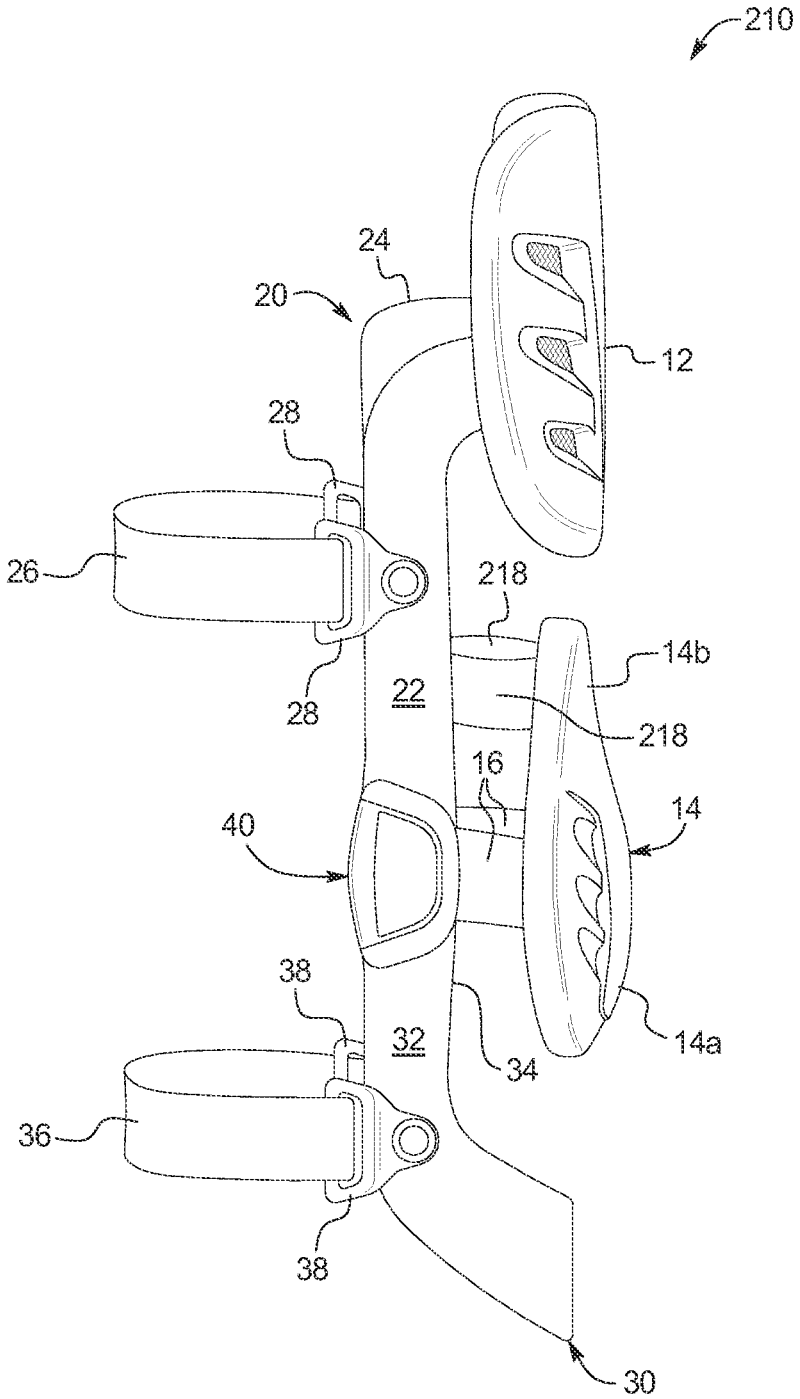
FIG. 3 is a perspective view of a third embodiment of an integrated sports leg protector of the present disclosure.

Referring now to FIG. 3, another alternative leg protector 210 is illustrated, in which all like features are numbered the same as in system 10 and 110 of FIGS. 1 and 2, and which may be provided with any of the alternative structures and functionality discussed above with FIGS. 1 and 2 and protectors 10 and 110, respectively. As illustrated with leg protector 210, patella or knee pad 14 is not connected with thigh pad 12 via a connecting strap 18, but is instead connected via straps 218 (one for each of lateral upright 22 and medial upright 24) to lateral upright 22 and medial upright 24. Straps 218 can be made of any of the materials discussed above for straps 18, 26 and 36. Further alternatively, straps 218 can be provided in addition to one or more strap 18 connecting patella or knee pad 14 to thigh pad 12. Patella pad 14 in the illustrated embodiment is still connected to lateral and medial hinges 40 via connecting straps 16.

Figure 4:
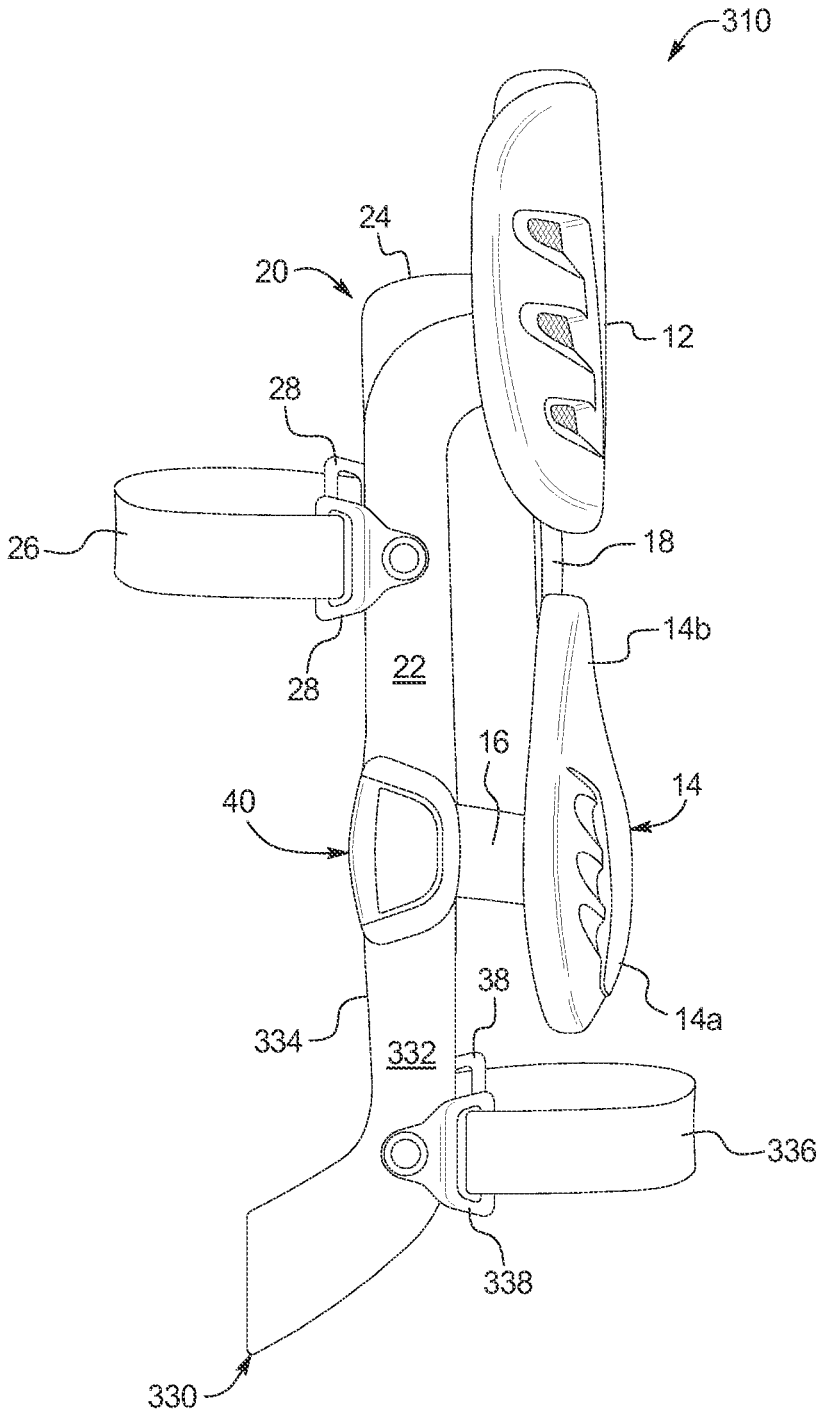
FIG. 4 is a perspective view of a fourth embodiment of an integrated sports leg protector of the present disclosure.

Referring now to FIG. 4, a further alternative leg protector 310 is illustrated, in which all like features are numbered the same as in systems 10, 110 and 210 of FIGS. 1 to 3, respectively, and which may be provided with any of the alternative structures and functionality discussed above with FIGS. 1 to 3 and protectors 10, 110 and 210, respectively. Here, alternative shell 330 extends from lateral upright 332 and the medial upright 334 (not seen in FIG. 4) around the back, posterior or calf of the player's leg, while a connecting strap 336 or garment sleeve extends around the front or anterior side of the player's lower leg. Strap 336, like straps 18, 26 and 36, can be expandable and/or adjustable and connected to lateral upright 332 and medial upright 334 via hinged connections 38 as shown in FIG. 4. Likewise, one or both ends of strap 336 can be releasably secured to a respective one of the hinges 38, or to lateral or medial uprights 332 and 334 via a respective one of the hinges 38, for donning and removal of protector 10.

It is contemplated that for any of the embodiments discussed herein, the thigh and knee pads be shaped, sized and arranged to help position the bracing shells 20 and 30 properly in place when worn. Likewise, shells 20 and 30 are structured and sized to help properly position the padding when worn.

Figure 5A:
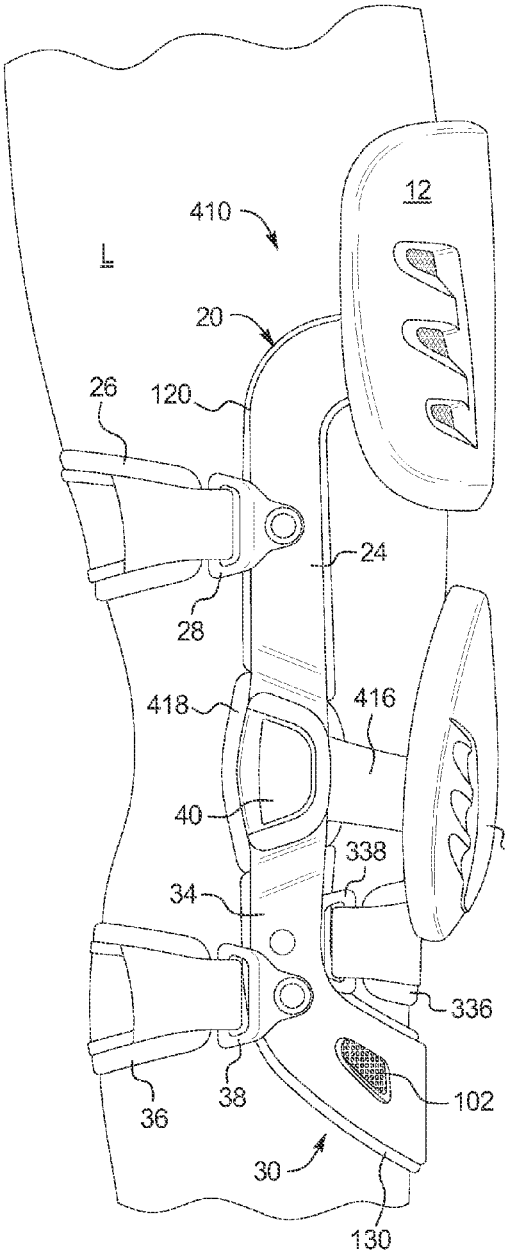
FIGS. 5A and 5B are side elevation and front views, respectively, of a fifth embodiment of an integrated sports leg protector of the present disclosure.
Figure 5B:
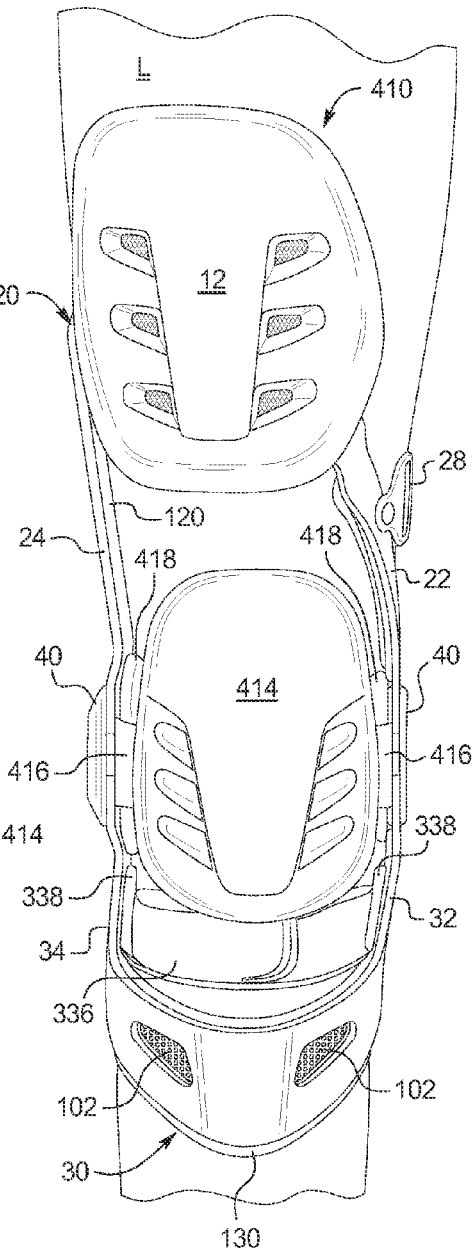

Referring now to FIGS. 5A and 5B, yet another alternative leg protector 410 is illustrated, in which all like features are numbered the same as with protectors 10, 110, 210 and 310 of FIGS. 1 to 4, and which may be provided with any of the alternative structures and functionality discussed above with protectors 10, 110, 210 and 310, respectively. Leg protector 410 is in certain respects a combination of protectors 210 and 310. Lea protector 410, like protector 210 (FIG. 3), does not provide a strap or member 18 connecting thigh pad 12 to patella or knee pad 414. Unlike protector 210, however, leg protector 410 also does not provide straps or members 218 connecting patella or knee pad 414 to lateral upright 22 and a medial upright 24. Instead, leg protector 410 relies on the anchoring of patella pad 414 to hinges 40 via extension members 416. Extension members 416 can be any suitable type of plastic and or metal, including any of those listed herein.

In an embodiment, extension members 416 extend into each other and all the way across the front of the player's knee. In such a case, the extension members 416 can extend through or along an inside surface of patella or knee pad 414. Alternatively, each extension member 416 terminates before extending all the way across the player's knee and connecting to each other. Here, the distal ends of extension members 416 can extend into patella or knee pad 414 or along the inside surface of same. Indeed, it is contemplated to attach patella or knee pad 414 to extension members 416 in any of the manners described herein for attaching the thigh pads 12, 212 (discussed below) and 512 (discussed below) to their respective upper shell extruding from their lateral and medial uprights. Extension members 416 provide adequate support for patella or knee pad 414, such that additional connection to either the upper shell 20 or thigh pad 12 is not needed. Connection to either or both the shell of thigh pad could be provided if desired however.

Extension members 416 in an embodiment extend to and mate with hinges 40, e.g., via any combination of press-fit, hook and pile, or fastening connection (e.g., screw, snap-fitting studs, buttons, tongue and groove, and any combination thereof) between extension members 416 and hinges 40. Side impact and therapeutic hinge knee pads 418 are attached in one embodiment to the inner surfaces of extension members 416, e.g., via hook and pile, or fastening connection. Thus a sandwiched configuration is formed with the extension member 416 layer residing between the inside surface of hinge 40 and the attachment surface of hinge knee pad 418. In this sandwiched configuration, it is contemplated to reinforce extension member 416 at the hinge, and thus reinforce the hinge 40, with spring steel, which in turn strengthens the entire upright/spring assembly with respect to lateral loads. Spring steel is so placed with the hinges on both sides of the player's knee to strengthen both lateral sides of the protector, which helps to absorb lateral loads and prevent or minimize medial collateral ligament ("MCL) and anterior collateral ligament ("ACL") injuries. Spring steel biasing can be provided for any of devices 10, 110, 210, 310, 410, 510, 610 and 710 described herein.

Patella or knee pad 414 of protector 410 is accordingly partially isolated from the movement of any of upper shell 20, lower shell 30 and thigh pad 12. Patella or knee pad 414 also does not move with or respond to the rotation of any portion of hinges 40 in the illustrated embodiment. Patella or knee pad 414 accordingly remains at least substantially in the position shown in FIGS. 5A and 5B, properly protecting the player's knee from front or anterior impact, regardless of the straightness or the bent position of the player's leg L and the corresponding positioning of upper shell 20, lower shell 30 and thigh pad 12.

Leg protector 410 also includes a lower anterior or front, e.g., adjustable, strap 336 that extends across the front of the lower part of the player's knee in the illustrated embodiment. Strap 336 can be made of any of the materials described herein for straps 18, 26 and 36. As illustrated in FIGS. 5A and 5B, any or all of straps 18, 26, 36 and 336 can have inner surface padding, e.g., foam, to provide additional protection and comfort. Strap 336 is attached to uprights 32 and 34 via hinges 338 to aid in providing a comfortable, form fit. Strap 336 accordingly provides additional impact protection to the lower part of the player's knee. For example, when the player's lower leg is bent, strap 336 ensures that the lower part of the player's knee remains protected even when rotated away slightly form the protection of patella or knee pad 414. Likewise, the, metallic, upper and lower shells 20 and 30 can be lined on their inner surfaces with mating, like-shaped plastic or foam padded liners to provide additional protection and comfort. In this manner, lower shell 30 extending across the player's lower leg for example provides impact protection for the player's shin. Lower shell 30 as illustrated can also be formed with openings 102, for reducing weight, lessening cost, and releasing heat and/or perspiration.

Figure 6A:
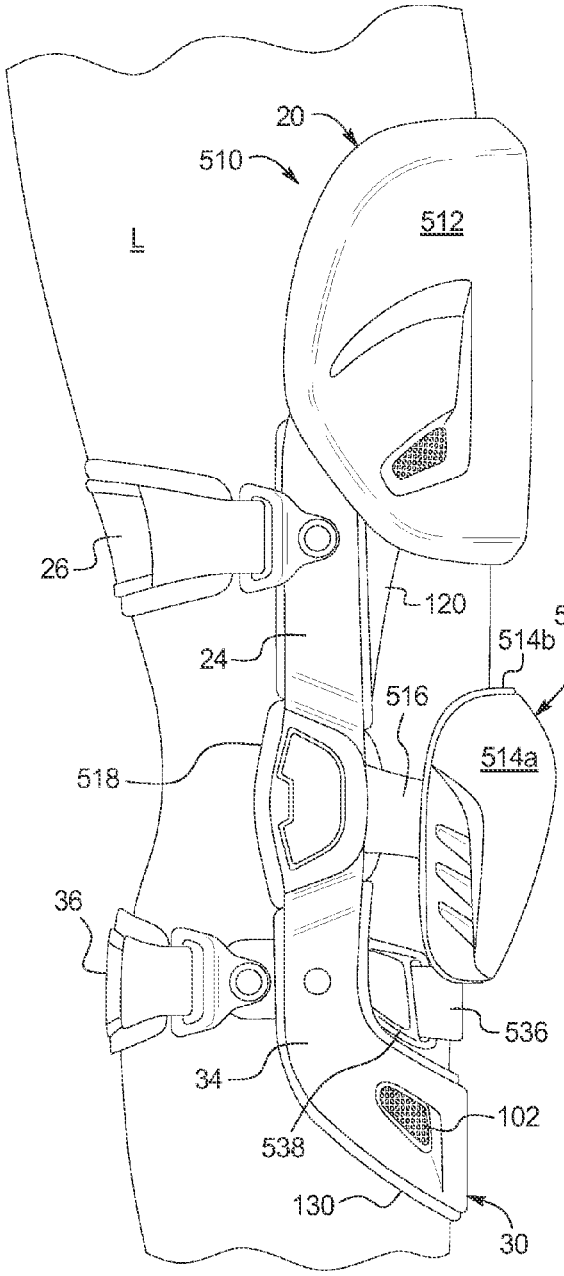
FIGS. 6A and 6B are side elevation and front views, respectively, of a sixth embodiment of an integrated sports leg protector of the present disclosure.
Figure 6B:
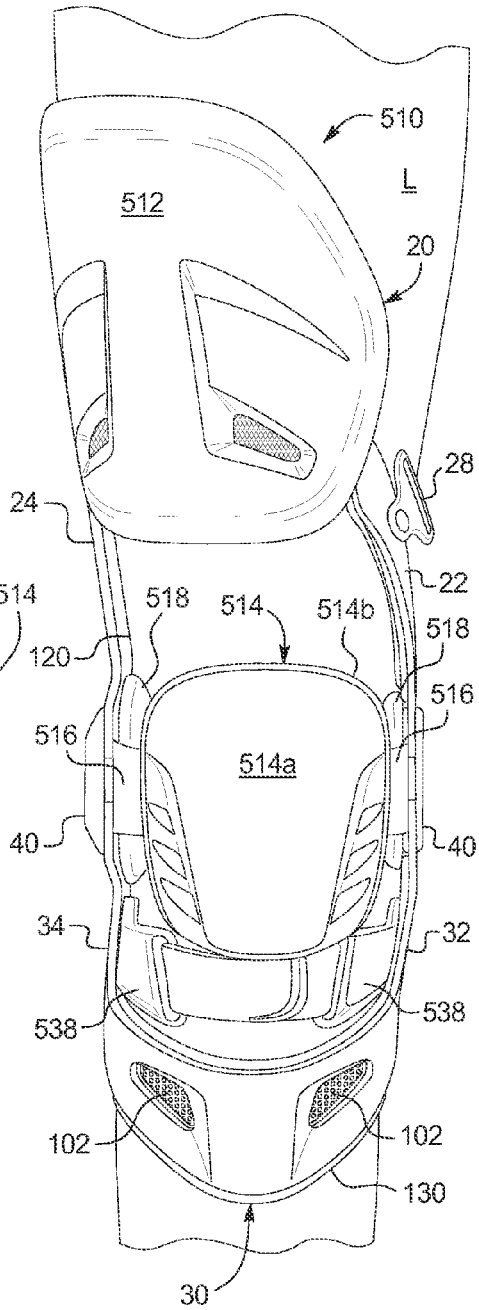

Referring now to FIGS. 6A and 6B, yet another alternative leg protector 510 is illustrated, in which all like features are numbered the same as with protectors 10, 110, 210, 310 and 410 of FIGS. 1 to 5, and which may be provided with any of the illustrated and alternative structures and functionality discussed above with protectors 10, 110, 210, 310 and 110, respectively. Leg protector 510 is quite similar to leg protector 410 and all of the structure and functionality discussed for protector 410 is equally applicable to protector 510. Knee pad 514 for protector 510 is somewhat different than pad 414 illustrated for protector 410. Here, extension members 516 extend to form a cup 514*b* to which outer foam knee pad 514*a* is secured, e.g., via press-fit, hook and pile, or fastening connection (e.g., screw, snap-fitting studs, buttons, tongue and groove, and any combination thereof). Extension members 516 at hinges 40 can be reinforced with spring steel, which in turn strengthen the entire upright/spring assembly with respect to lateral loads, as described with protector 410. Hinged connectors 538 for strap 536 extend frontwardly further than do like hinge connections 333 for straps 336. Otherwise, knee pad 514 and strap 536 (e.g., adjustable) function as described, above for knee pad 414 and strap 336.

Leg protector 510 also differs in that thigh pad 512 extends further around onto the side of the player's thigh than do thigh pads 12 discussed above. Thigh pads 512 accordingly provide additional side impact protection to the player's thigh. Thigh pads 512 and any associated modification to, or moving over of, upper shell 20 can be provided with any of the other protectors 10, 110, 210, 310 or 410 discussed herein.

Figure 7:
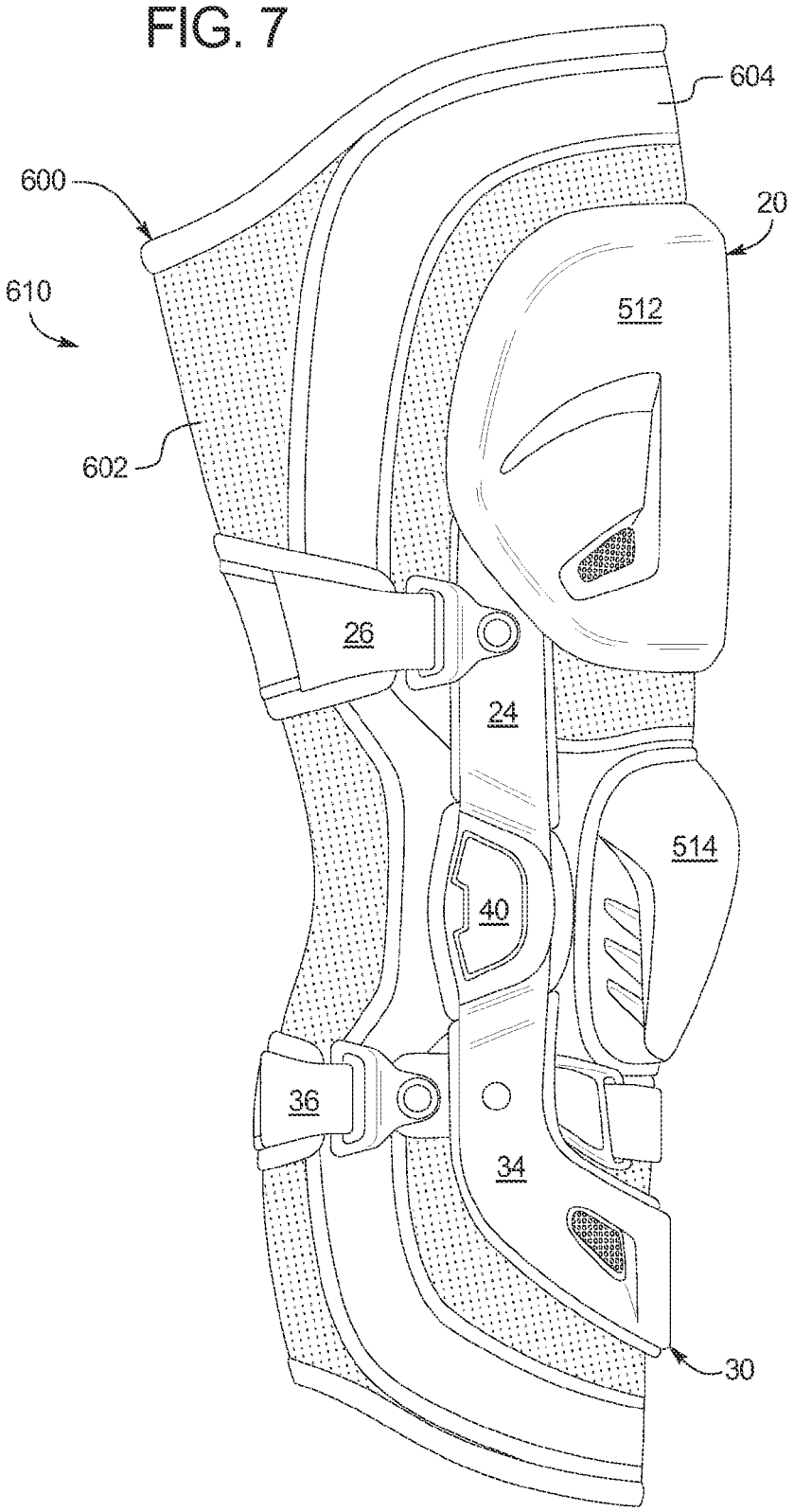
FIG. 7 is a side elevation view of a seventh embodiment of an integrated sports leg protector of the present disclosure.

Referring now to FIG. 7, yet a further alternative embodiment of leg protector is illustrated by protector 610 is illustrated. Leg protector 610 is shown in operation with a garment sleeve 600. Garment sleeve 600 may be used alternatively with any of protectors 10, 11.0, 210, 310, 410 or 510 discussed herein. Garment sleeve 600 can be made of a spandex or elastane material or of another synthetic fiber material having good elasticity. In FIG. 7, a single garment sleeve 600 for the player's upper and lower leg is provided, while garment sleeves 126 and 136 of FIG. 2 are each dedicated to one or the other of the upper and lower leg. Garment sleeves 126 and 136 are also attached to protector 110, while single garment sleeve 600 is worn separately from the leg protector, e.g., leg protector 510. Garment sleeve 600 can be generally continuous as illustrated so that players insert their legs through the sleeves to don sleeve 600. Alternatively, garment sleeve 600 is slit and provided with attachable edges, e.g., via hook and pile attachment, so that sleeve can alternately be translated onto (before attaching hook and pile edges at a desired tightness) and off of (after separating hook and pile edges) the player. Garment sleeve 600 applies a slight compressive force to the player's leg, which tends to hold muscles, ligaments and bones together and provides a comforting feel for the player.

Garment sleeve 600 can itself provide an, e.g., continuous, padded strip 604 (e.g., leather, animal hide, plastic or foam), allowing the leg to flex, but providing additional and expanded support and impact protection. Protector 610 is very similar to protector 510, including upper shell 20, lower shell 30, hinges 40 and thigh pad 512. In the illustrated embodiment, however, knee or patella pad 514 is attached to padded strip 604 of garment sleeve 600, e.g., via an adhesive and/or stitching. Alternatively, knee or patella pad 514 is attached directly to the spandex elastane material, e.g., via stitching. In either case, the player first dons garment sleeve 600 and knee pad 514 with it. Next, the player applies upper shell 20, lower shell 30, hinges 40 and thigh pad 512. Alternatively, garment sleeve 600 is pre-attached to upper shell 20, lower shell 30, hinges 40, knee pad 514 and thigh pad 512, such that protector 610 is applied to the player all at once.

Further alternatively, knee pad 514 is attached to hinges 40 as in FIGS. 6A and 6B, or according to any other structure and methodology discussed herein. Still further alternatively, thigh pad 512 is attached to garment sleeve 600 (or padded strip 604 of garment sleeve 600) as opposed to or in addition to knee pad 514.

Figure 8:
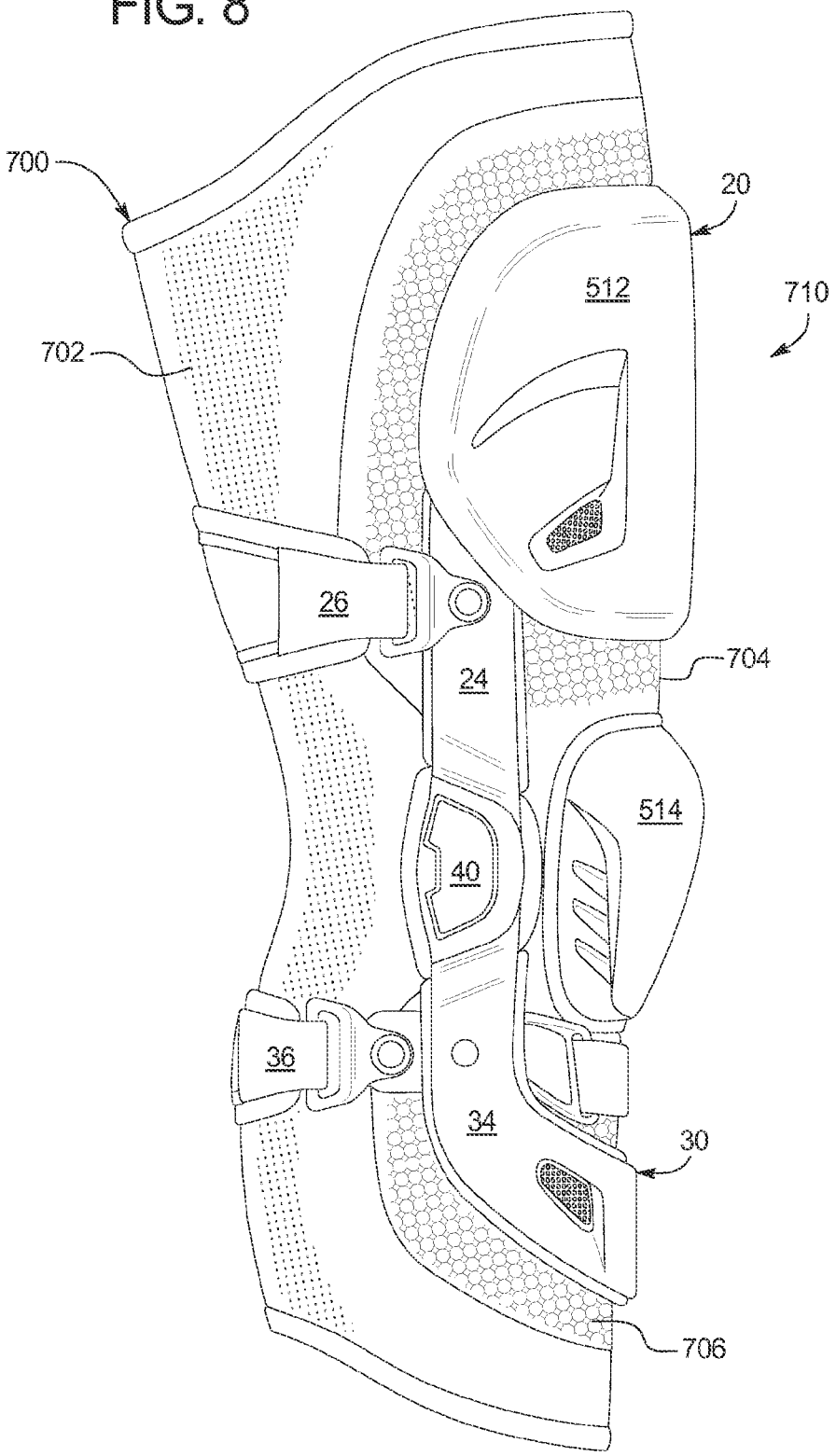
FIG. 8 is a side elevation view of an eighth embodiment of an integrated sports leg protector of the present disclosure.

Referring now to FIG. 8, another embodiment of for a leg protector is illustrated by leg protector 710. Leg protector 710 is shown in operation with a garment sleeve 700. Garment sleeve 700 may be used alternatively with any of protectors 10, 110, 210, 310, 410 or 510 discussed herein. Garment sleeve 700 can again be made of a spandex or elastane material or of another synthetic fiber material having good elasticity, and be continuous or slit as with sleeve 700. Garment sleeve 700 likewise applies a slight compressive force to the player's leg, which tends to hold muscles, ligaments and bones together. External padded strip 604 of system 610 has been replaced (but could be in addition to) upper and lower stretchable reinforcement or padded sections 704 and 706, which may or may not meet and extend over some or all of the player's knee. Stretchable reinforcement or padded sections 704 and 706 can for example be multiple layers of the material used to form garment sleeve 700 or include a thin, e.g., leather, animal hide, plastic or foam, layer that provides additional impact protection to the user's thigh and lower anterior leg, respectively.

Protector 710 is very similar to protector 510, including upper shell 20, lower shell 30, hinges 40 and thigh pad 512. In the illustrated embodiment, however, knee or patella pad 514 is attached to padded sections 704 and 706 of garment sleeve 700, e.g., via an adhesive and/or stitching. The player again first dons garment sleeve 700 and knee pad 514 with it. Next, the player applies upper shell 20, lower shell 30, hinges 40 and thigh pad 512. Alternatively, garment sleeve 700 is also pre-attached to upper shell 20, lower shell 30, hinges 40 and thigh pad 512, such that protector 710 is applied to the player all at once. Further alternatively, knee pad 514 is attached to hinges 40 as in FIGS. 6A and 6B or according to any other structure and methodology discussed herein. Still further alternatively, thigh pad 512 is attached to garment sleeve 700 (or padded sections 704 and 706 of garment sleeve 710) as opposed to or in addition to knee pad 514.

Figure 9:
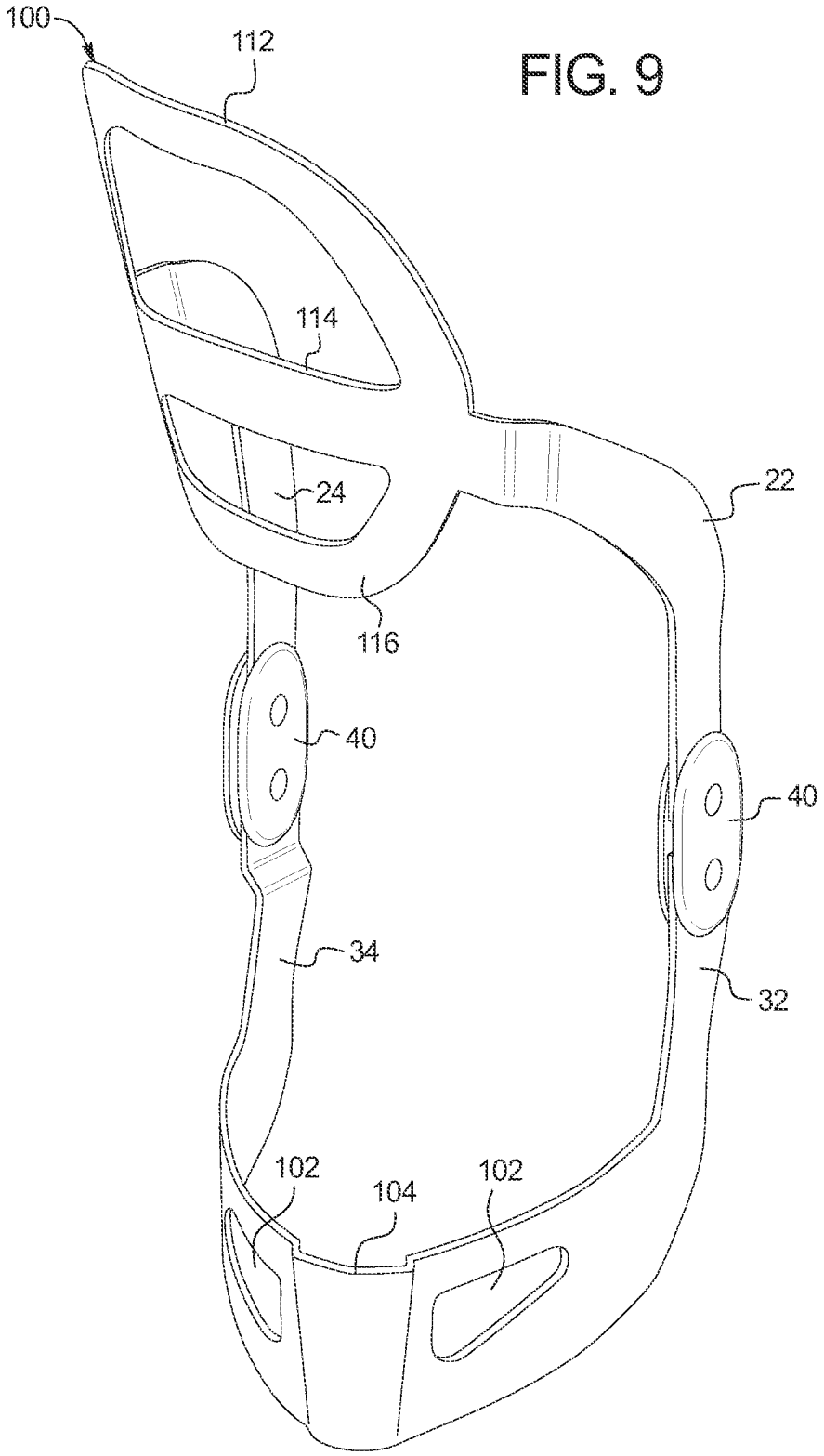
FIG. 9 is a perspective view of one embodiment of a frame useable with the sports leg protectors of the present disclosure.

Referring now to FIG. 9, an embodiment of a frame 100 is illustrated. Frame 100 can be aluminum, magnesium, alloys thereof plastic, a composite material or combinations thereof for example. Frame provides upper uprights 22 and 24 and lower uprights 32 and 34 as illustrated. Lateral uprights 22 and 32 are connected via a hinge 40, as are medial uprights 24 and 34. The insides of hinges 40 shown in FIG. 9 receive the extension members 416 and 516 discussed above for patella or knee hinges 414 and 514, respectively. The lower front 104 of frame 100 includes or defines openings or apertures 102 discussed above. The upper front of frame 100 is provided in the illustrated embodiment with three, e.g., horizontal, members 112, 114 and 116. Members 112, 114 and 116 are used to secure and support the thigh pad as discussed herein.

Figure 10:
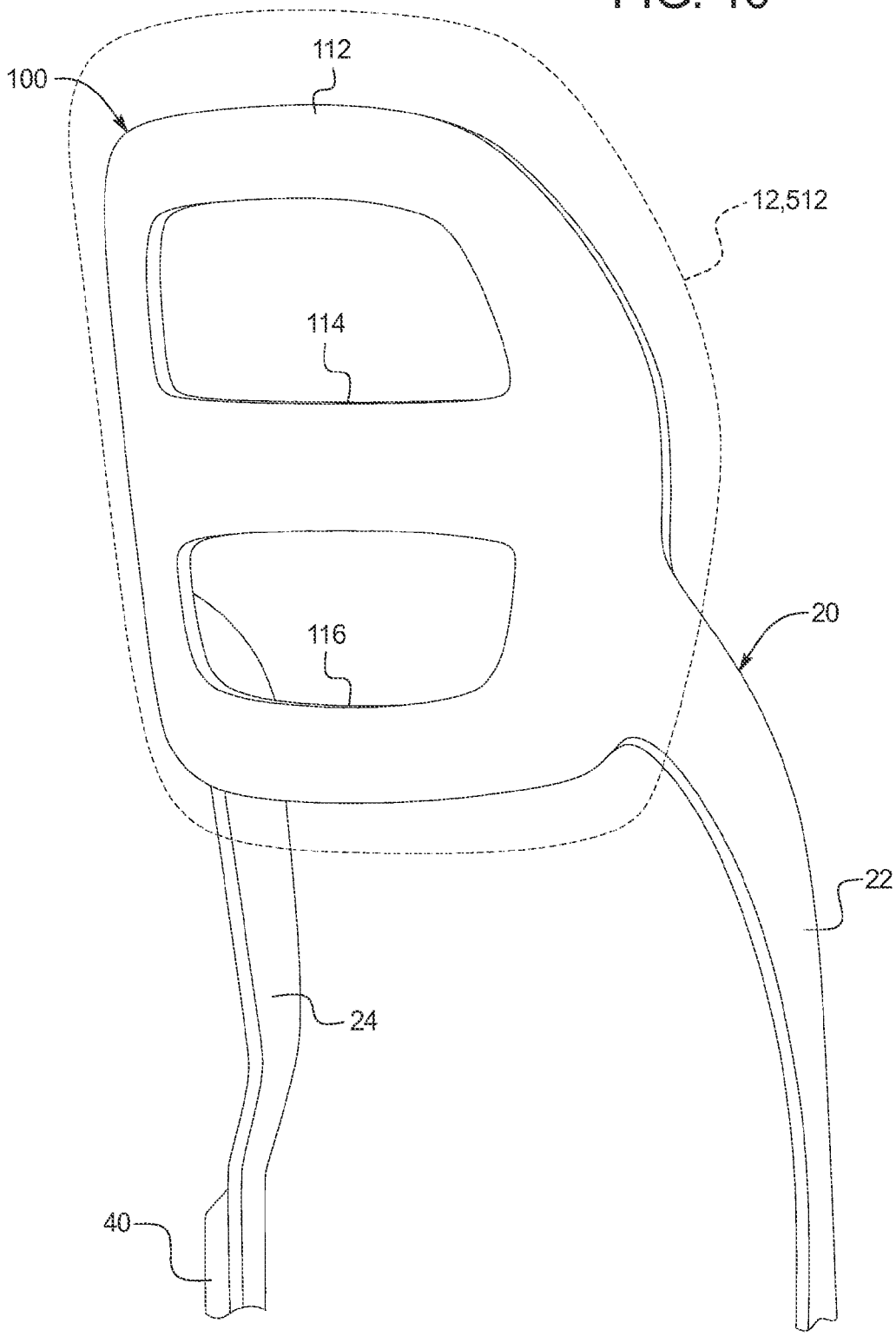
FIG. 10 is a perspective view of one embodiment of a thigh pad and associated assembly useable with the sports leg protectors of the present disclosure.

Referring now to FIG. 10, embodiments for attaching thigh pads 12 and 512 to upright 20 are illustrated. Pads 12 and 512 are shown in phantom to illustrate how they fit around and between members 112, 114 and 116. Pads 12 and 512 can be made of vinyl nitride, for example, and be molded over and between members 112, 114 and 116. Alternatively, pads 12 and 512 are made of vinyl nitride halves that are placed on either side of members 112, 114 and 116. The halves are then bonded and/or fastened to each other and/or to the members.

Figure 11:
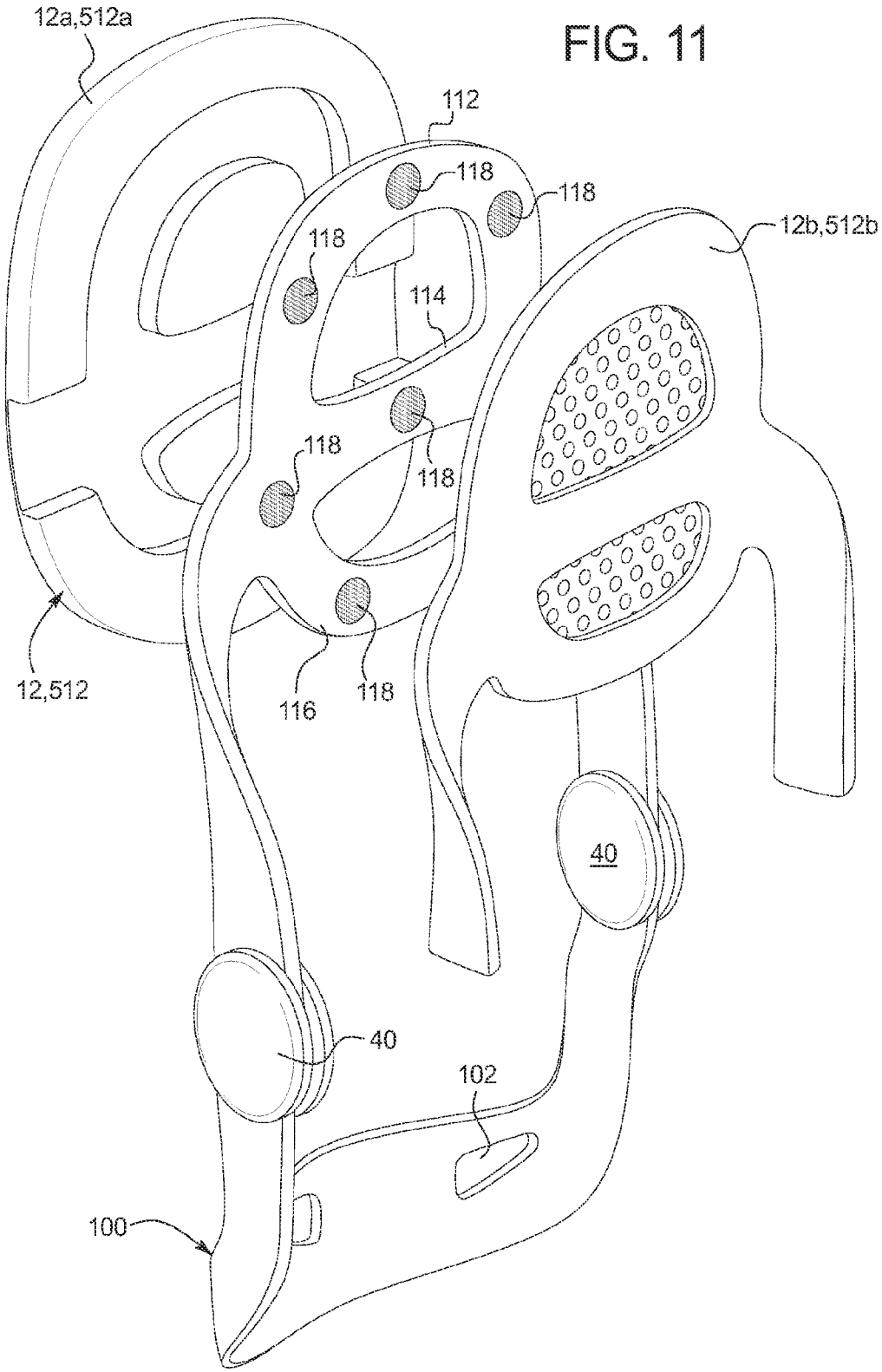
FIG. 11 is a perspective view of another embodiment of a thigh pad and associated assembly useable with the sports leg protectors of the present disclosure.

Referring now to FIG. 11, another embodiment for attaching thigh pads 12 and 512 to upright 20 is illustrated. Pads 12 and 512 are shown in halves 12*a*, 512*a*, e.g., vinyl nitride halves, residing on the outsides of members 112, 114 and 116 and in halves 12*b*, 512*b*, e.g., leather or animal hide halves, residing on the insides of members 112, 114 and 116. Inner halves 12*b*, 512*b* can be perforated as illustrated to release heat and/or perspiration. Pile or hook areas 118 are attached, e.g., adhered, to the insides of members 112, 114 and 116. Pile or hook areas 118 attach removably to matching hook or pile areas placed on the outer surfaces of inner halves 12*b*, 512*b*. Outer halves 12*a*, 512*a* have grooves as illustrated that mate intimately with members 112, 114 and 116. The surfaces of the grooves are adhered to the outer surfaces of members 112, 114 and 116 in one embodiment. Outer halves 12*a*, 512*a* are alternatively fixed to inner halves 12*b*, 512*b* and/or members 112, 114 and 116 via press-fit, hook and pile, or fastening connection (e.g., screw, snap-fitting studs, buttons, tongue and groove), and any combination thereof.

Figure 12:
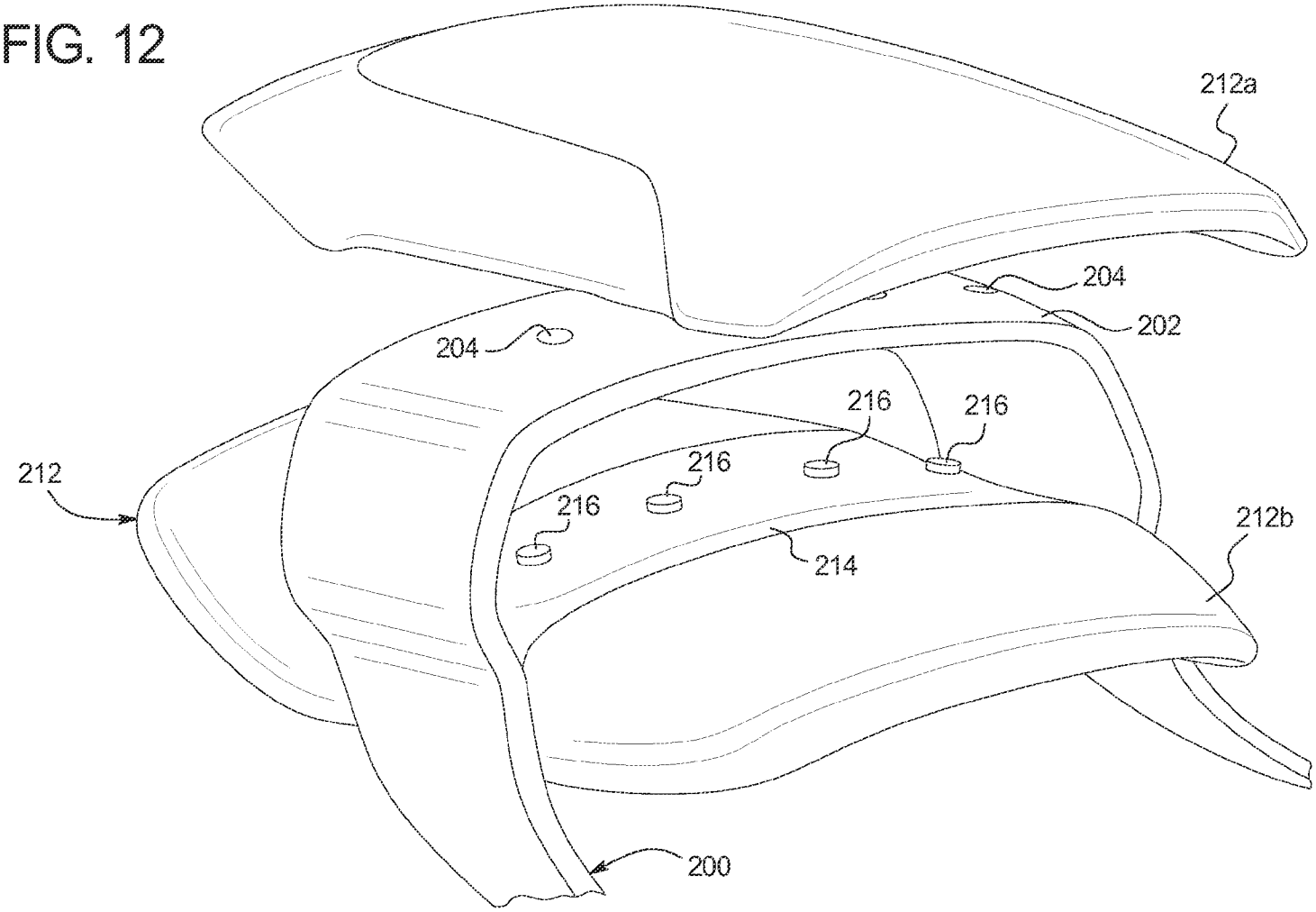
FIG. 12 is a perspective view of a further embodiment of a thigh pad and associated assembly useable with the sports leg protectors of the present disclosure.

Referring now to FIG. 12, alternative upper upright 200 with pad mounting strut 202 is illustrated receiving alternative thigh pad 212, which is made of pad halves 212*a* and 212*b*. Halves 212*a* and 212*b* can both be made of foam, such as vinyl nitride. Inner half 212*b* is provided, with a reinforcing strip 214 having studs 216 extending therefrom. Studs 216 extend through mating holes 204 provided in strut 202. Studs 216 extend into the inside of half pad 212*a* and snap-fit or otherwise releasably mechanically lock with mating structures formed on the inside surface of the outer pad half 212*a*. Studs 216 can alternatively or additionally be adhered to the receiving structure of outer pad half 212*a*.

It is contemplated that for any of the protectors 10, 110, 210, 310, 410, 510, 610 or 710 and associated alternatives discussed herein, that thigh pads, such as thigh pads 12, 212 and 512 can be located alternatively in pockets of the player's uniform, such as in an inside pocket of a pair of American football pants.

Aspects of the subject matter described herein may be useful alone or in combination one or more other aspect described herein. Without limiting the foregoing description, in a first aspect of the present disclosure, a sports-play leg protector includes: an upper bracing shell; a lower bracing shell; first and second hinges connecting the upper bracing shell to the lower bracing shell; a thigh pad supported by the upper bracing shell; and a knee pad supported by the sports-play leg protector.

In accordance with a second aspect of the present disclosure, which may be used in combination with the first aspect, the knee pad is supported by the first and second hinges.

In accordance with a third aspect of the present disclosure, which may be used in combination with any one or more of the preceding aspects, the knee pad is formed to bend towards, extend to, and connect with the first and second hinges.

In accordance with a fourth aspect of the present disclosure, which may be used in combination with any one or more of the preceding aspects, the knee pad is supported by at least one of the upper bracing shell or the thigh pad.

In accordance with a fifth aspect of the present disclosure, which may be used in combination with any one or more of the preceding aspects, the upper bracing shell extends into the thigh pad.

In accordance with a sixth aspect of the present disclosure, which may be used in combination with any one or more of the preceding aspects, the upper bracing shell is connected to an inner surface of the thigh pad.

In accordance with a seventh aspect of the present disclosure, which may be used in combination with any one or more of the preceding aspects, the lower bracing shell is configured to extend in front of the player's lower leg.

In accordance with an eighth aspect of the present disclosure, which may be used in combination with any one or more of the preceding aspects, the lower bracing shell is configured to extend in back of the player's lower leg.

In accordance with a ninth aspect of the present disclosure, which may be used in combination with any one or more of the preceding aspects, at least one of the upper and lower bracing shells is configured to be strapped to the player.

In accordance with a tenth aspect of the present disclosure, which may be used in combination with any one or more of the preceding aspects, wherein at least one of the upper and lower bracing shells is at least one of (i) hingedly, (ii) adjustably, or (iii) stretchably strapped to the player.

In accordance with an eleventh aspect of the present disclosure, which may be used in combination with any one or more of the preceding aspects, at least one of the upper and lower bracing shells is held to the player via or outside of a garment.

In accordance with a twelfth aspect of the present disclosure, which may be used in combination with any one or more of the preceding aspects, the thigh and knee pads are configured and arranged to absorb an anterior load.

In accordance with a thirteenth aspect of the present disclosure, which may be used in combination with any one or more of the preceding aspects, the sports-play leg protector includes an adjustable connector connecting the thigh pad to the knee pad.

In accordance with a fourteenth aspect of the present disclosure, which may be used in combination with any one or more of the preceding aspects, at least one of the upper and lower bracing shells extends continuously from a lateral upright to a medial upright of the respective shell.

In accordance with a fifteenth aspect of the present disclosure, which may be used in combination with any one or more of the preceding aspects, at least one of the upper and lower bracing shells includes lateral and medial uprights that each terminate at a respective distal end.

In accordance with a sixteenth aspect of the present disclosure, which may be used in combination with any one or more of the preceding aspects, at least one of the first and second hinges has a motion restrictor.

In accordance with a seventeenth aspect of the present disclosure, which may be used in combination with any one or more of the preceding aspects, at least one of the first and second hinges is padded for player comfort.

In accordance with an eighteenth aspect of the present disclosure, which may be used in combination with any one or more of the preceding aspects, a sports-play leg protector comprising: an upper bracing shell; a lower bracing shell; first and second hinges connecting the upper bracing shell to the lower bracing shell; a thigh pad supported by the upper bracing shell; and a knee pad supported by at least one of the upper bracing shell and the thigh pad.

In accordance with a nineteenth aspect of the present disclosure, which may be used in with any one or more of the preceding aspects in combination with the eighteenth aspect, the knee pad is further supported by at least one of the first and second hinges.

In accordance with a twentieth aspect of the present disclosure, which may be used in with any one or more of the preceding aspects, at least one of the first and second hinges is uni- or polycentric.

In accordance with a twenty-first aspect of the present disclosure, which may be used with an one or more of the preceding aspects, the thigh pad is molded over or fastened around at least a portion of the upper bracing shell.

In accordance with a twenty-second aspect of the present disclosure, which may be used with any one or more of the preceding aspects, sports-play leg protector includes: an upper bracing shell; a lower bracing shell; first and second hinges placed between the upper and lower bracing shells, the first and second hinges providing side impact protection to a player's knee; a thigh pad supported by the upper bracing shell, the thigh pad providing front impact protection to the player's thigh; and a knee pad supported by at least one of (i) the first and second hinges, (ii) the thigh pad or (iii) the upper bracing shell, the knee pad providing front impact protection to the player's knee.

In accordance with a twenty-third aspect of the present disclosure, which may be used with any one or more of the preceding aspects, in combination with the twenty-second aspect, the protector also provides a protective benefit to an injured knee of the player during sports play.

In accordance with a twenty-fourth aspect of the present disclosure, which may be used with any one or more of the preceding aspects, the thigh pad is sized and arranged to additionally provide side impact protection to the player's thigh.

In accordance with a twenty-fifth aspect of the present disclosure, which may be used with any one or more of the preceding aspects, at least one of the hinges is reinforced to in turn strengthen the assembly with respective uprights of the upper and lower bracing shells.

In accordance with a twenty-sixth aspect of the present disclosure, which may be used with any one or more of the preceding aspects, at least one of the upper and lower bracing shells is held to the player via or outside of a garment sleeve, and wherein the knee pad is attached to the garment sleeve.

In accordance with a twenty-seventh aspect of the present disclosure, any of the structure and functionality illustrated and described in connection with FIGS. 1 to 12 may be used in combination with any one or more of the preceding aspects.

It should be understood that various changes and modifications to the presently preferred embodiments described herein will be apparent to those skilled in the art. Such changes and modifications can be made without departing from the spirit and scope of the present subject matter and without diminishing its intended advantages. It is therefore intended that such changes and modifications be covered by the appended claims.

The invention is claimed as follows:

1. A sports-play leg protector comprising:

an upper bracing shell including a lateral upright, a medial upright, the lateral upright and medial upright extending generally vertically when in use, and at least one member extending generally horizontally when in use between the lateral upright and the medial upright, the at least one member including front and rear surfaces;

a lower bracing shell;

first and second hinges connecting the upper bracing shell to the lower bracing shell;

a thigh pad completely encircling the generally horizontally extending front and rear surfaces of the at least one member, the thigh pad extending outwardly from the at least one member for contact during sports play; and a knee pad supported by the sports-play leg protector.

2. The sports-play leg protector of claim 1, wherein the knee pad is supported by the first and second hinges.

3. The sports-play leg protector of claim 1, wherein the knee pad is formed to bend towards, extend to, and connect with the first and second hinges.

4. The sports-play leg protector of claim 1, wherein the knee pad is supported by at least one of the upper bracing shell or the thigh pad.

5. The sports-play leg protector of claim 1, wherein the at least one member extends into the thigh pad.

6. The sports-play leg protector of claim 1, wherein the at least one member is connected to an inner surface of the thigh pad.

7. The sports-play leg protector of claim 1, wherein the thigh pad is molded over or fastened around the at least one member.

8. The sports-play leg protector of claim 1, wherein the lower bracing shell is configured to extend in front of a player's lower leg.

9. The sports-play leg protector of claim 1, wherein the lower bracing shell is configured to extend in back of a player's lower leg.

10. The sports-play leg protector of claim 1, wherein at least one of the upper and lower bracing shells is configured to be strapped to a player.

11. The sports-play leg protector of claim 1, wherein at least one of the upper and lower bracing shells is at least one of (i) hingedly, (ii) adjustably, or (iii) stretchably strapped to a player.

12. The sports-play leg protector of claim 1, wherein at least one of the upper and lower bracing shells is held to a player via or outside of a garment sleeve.

13. The sports-play leg protector of claim 12, wherein the knee pad is attached to the garment sleeve.

14. The sports-play leg protector of claim 1, wherein the thigh and knee pads are configured and arranged to absorb an anterior load.

15. The sports-play leg protector of claim 1, wherein the sports-play leg protector includes an adjustable connector connecting the thigh pad to the knee pad.

16. The sports-play leg protector of claim 1, wherein the at least one member extends continuously from the lateral upright to the medial upright.

17. The sports-play leg protector of claim 1, wherein at least one of the first and second hinges has a motion restrictor.

18. The sports-play leg protector of claim 1, wherein at least one of the first and second hinges is padded for player comfort.

19. The sports-play leg protector of claim 1, wherein at least one of the first and second hinges is uni- or polycentric.

20. A sports-play leg protector comprising:

an upper bracing shell including a lateral upright, a medial upright, and at least one member extending generally horizontally when in use between the lateral upright and the medial upright;

a lower bracing shell;

first and second hinges connecting the upper bracing shell to the lower bracing shell;

a thigh pad completely encircling and thereby covering front and rear surfaces of the at least one generally horizontal member extending between the lateral upright and the medial upright; and a knee pad supported by at least one of the upper bracing shell and the thigh pad.

21. The sports-play leg protector of claim 20, wherein the knee pad is further supported by at least one of the first and second hinges.

22. A sports-play leg protector comprising:

an upper bracing shell including a lateral upright, a medial upright, and at least one member extending generally horizontally when in use between the lateral upright and the medial upright;

a lower bracing shell;

first and second hinges placed between the upper and lower bracing shells, the first and second hinges providing side impact protection to a player's knee;

a thigh pad completely encircling front and rear surfaces of the at least one generally horizontal member extending between the lateral and medial uprights, the thigh pad extending outwardly from the at least one member so as to provide front impact protection to the player's thigh; and a knee pad supported by at least one of (i) the first and second hinges, (ii) the thigh pad or (iii) the upper bracing shell, the knee pad providing front impact protection to the player's knee.

23. The sports-play leg protector of claim 22, which additionally provides a protective benefit to an injured knee of the player during sports play.

24. The sports-play leg protector of claim 22, wherein the thigh pad is sized and arranged to additionally provide side impact protection to the player's thigh.

25. The sports-play leg protector of claim 22, wherein at least one of the hinges is reinforced to in turn strengthen the assembly against a lateral load.

26. The sports-play leg protector of claim 1, wherein the at least one member includes an upper member, a middle member and a lower member, and wherein the thigh pad is fitted around at least the middle member.

27. The sports-play leg protector of claim 1, wherein the thigh pad includes two halves that are placed on either side of the at least one member.

28. The sports-play leg protector of claim 27, wherein the two halves are bonded or fastened to each other around the at least one member.

29. The sports-play leg protector of claim 27, wherein the two halves are bonded or fastened to the at least one member.

30. The sports-play leg protector of claim 1, wherein the thigh pad includes a first portion in contact with a second portion to completely encircle the at least one member.

31. The sports-play leg protector of claim 20, wherein the thigh pad includes a first portion in contact with a second portion to completely encircle the at least one member.

32. The sports-play leg protector of claim 22, wherein the thigh pad includes a first portion in contact with a second portion to completely encircle the at least one member.

33. A sports-play leg protector comprising:

an upper bracing shell including a lateral upright, a medial upright, and at least one member extending between the lateral and medial uprights;

a lower bracing shell;

first and second hinges connecting the upper bracing shell to the lower bracing shell;

a thigh pad completely encircling the at least one member so as to extend outwardly for contact during sports plays; and the at least one member includes an upper member, a middle member and a lower member;

and a knee pad supported by the sports-play leg protector.

* * * * *